US005351474A

United States Patent [19]

Slocum et al.

[11] Patent Number: 5,351,474

[45] Date of Patent: Oct. 4, 1994

[54] COMBUSTOR EXTERNAL AIR STAGING DEVICE

[75] Inventors: Gale V. Slocum, Clifton Park; Albert Myers, Amsterdam; Kenneth W. Beebe, Saratoga, all of N.Y.

[73] Assignee: General Electric Company, Schenectady, N.Y.

[21] Appl. No.: 75,360

[22] Filed: Apr. 16, 1993

Related U.S. Application Data

[63] Continuation of Ser. No. 809,139, Dec. 18, 1991, abandoned.

[51] Int. Cl.[5] ..... F02C 9/00

[52] U.S. Cl. ..... 60/39.23; 60/39.37

[58] Field of Search ..... 60/39.23, 39.37, 39.39, 60/760

[56] References Cited

U.S. PATENT DOCUMENTS

| | | | |
|---|---|---|---|
| 2,458,066 | 1/1949 | Farkas et al. | 60/39.23 |
| 2,621,477 | 12/1952 | Powter et al. | 60/39.23 |
| 3,577,878 | 5/1971 | Greenwood | 60/39.65 |
| 3,691,761 | 9/1972 | Jackson et al. | 60/39.23 |
| 3,731,484 | 5/1973 | Jackson et al. | 60/39.23 |
| 3,765,171 | 10/1973 | Hagen et al. | 60/39.23 |
| 3,930,368 | 1/1976 | Anderson et al. | 60/39.23 |
| 3,930,369 | 1/1976 | Verdouw | 60/39.65 |
| 4,063,415 | 12/1977 | Rhoades | 60/261 |
| 4,160,362 | 7/1979 | Martens et al. | 60/39.18 |
| 4,255,927 | 3/1981 | Johnson et al. | 60/39.23 |
| 4,259,837 | 4/1981 | Russell et al. | 60/39.55 |
| 4,290,558 | 9/1981 | Coburn et al. | 239/400 |
| 4,292,801 | 10/1981 | Wilkes et al. | 60/39.06 |
| 4,337,618 | 7/1982 | Hughes et al. | 60/39.55 |
| 4,353,205 | 10/1982 | Cleary | 60/39.23 |
| 4,628,687 | 12/1986 | Ström | 60/39.23 |
| 4,807,433 | 2/1989 | Maclin et al. | 60/39.29 |
| 4,944,149 | 7/1990 | Kuwata | 60/39.23 |
| 4,982,570 | 1/1991 | Waslo et al. | 60/733 |

*Primary Examiner*—Richard A. Bertsch
*Assistant Examiner*—Michael I. Kocharov
*Attorney, Agent, or Firm*—Nixon & Vanderhye

[57] ABSTRACT

A gas turbine combustion system includes a plurality of combustors within a pressure vessel, each combustor including a combustion liner defining a combustion chamber having a reaction zone and a dilution zone, the liner in the dilution zone provided with a plurality of circumferentially spaced dilution air feed holes. A flow shield surrounds each combustion liner in radially spaced relation thereto for feeding compressor discharge air to the combustion chamber. Air staging apparatus directly controls the amount of compressor discharge air fed into each combustion chamber dilution zone via the dilution air feed holes. The apparatus includes a plurality of pressure vessel extraction ports and associated conduits for introducing compressor discharge air into a first manifold common to the plurality of combustors; a dilution air control valve located between each extraction port and the first manifold; and a second, annular manifold surrounding the flow shield and including feed tubes connecting the second manifold to each of the dilution air feed holes in the combustion liner.

8 Claims, 1 Drawing Sheet

FIG. 1
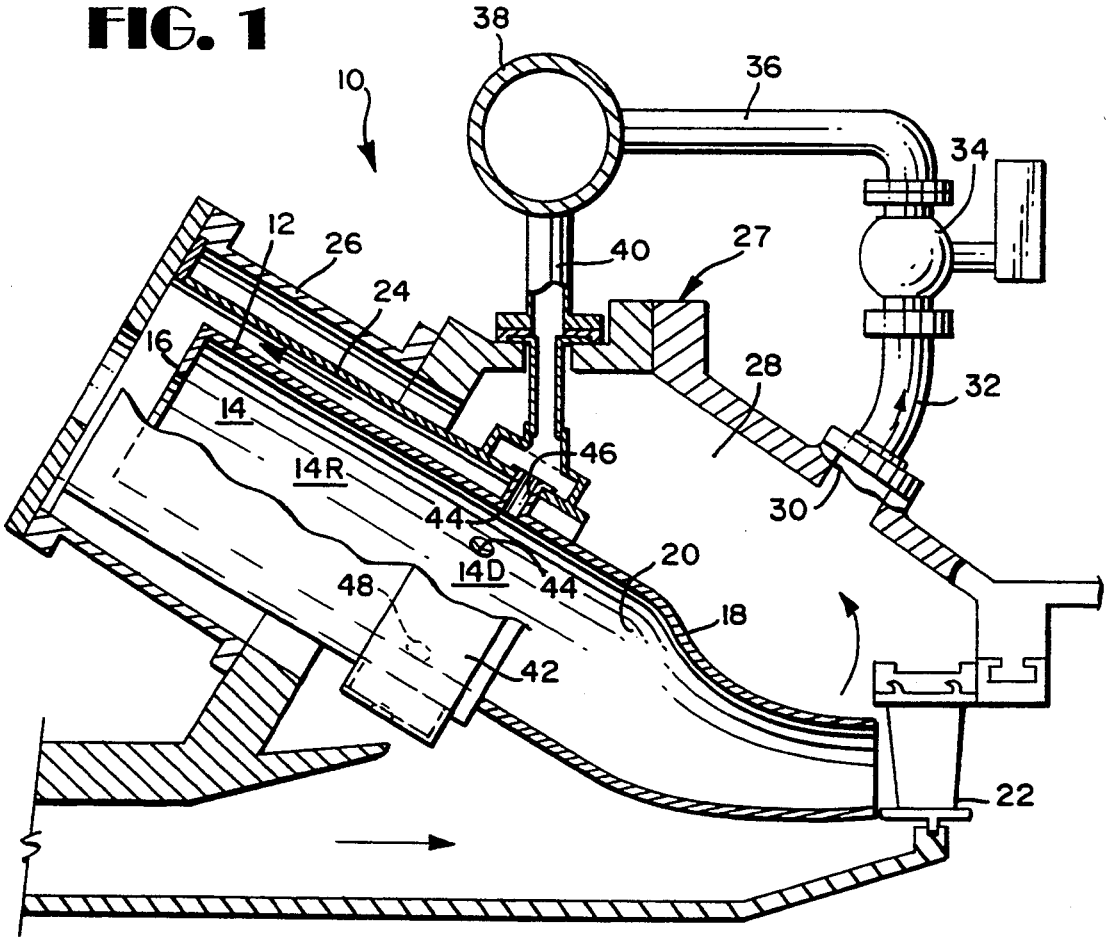
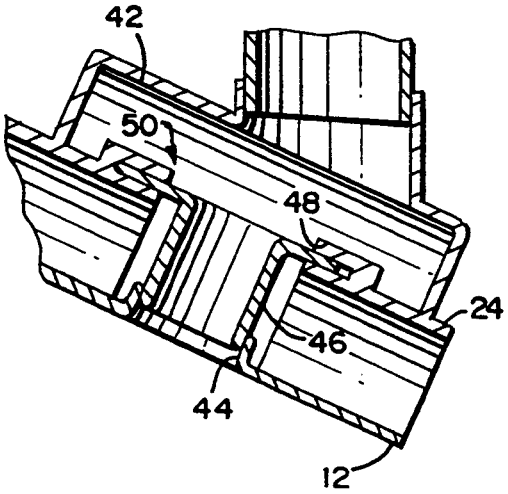
FIG. 2

COMBUSTOR EXTERNAL AIR STAGING DEVICE

This is a continuation of application Ser. No. 07/809,139, filed Dec. 18, 1991, now abandoned.

The present invention relates in general to improved combustion control and more specifically, to an air staging control system for gas turbines which is capable of burning gaseous fuels while minimizing the emission of nitrogen oxides, smoke and other undesirable exhaust pollutants.

BACKGROUND AND SUMMARY OF THE INVENTION

The nature of gas turbines is such that they emit small amounts of undesirable pollutants into the surrounding atmosphere. Although smoke, excess carbon monoxide and unburned hydrocarbons all constitute undesirable pollutants in the exhaust of gas turbines, it is the emissions of excess amounts of nitrogen oxides (NOx) which causes particular concern, as a result of the adverse effects attributed to these gases.

It is well known that lowering tile temperature of combustion will decrease tile concentration of nitrogen oxides in the turbine exhaust gases. It has also been demonstrated that burning the fuel with excess air, i.e., using a fuel-lean mixture in the combustion process, will accomplish a temperature reduction. However, the leanness of the fuel-air mixture required to effect a flame temperature reduction at full turbine load will not support a satisfactory flame under low load or under start-up conditions. When the latter conditions prevail, the turbine will operate at poor combustion efficiency, or not at all, if the same fuel mixture is used as at full load. Incomplete burning of the fuel mixture will occur, resulting in the presence of excessive amounts of carbon monoxide and unburned hydrocarbons in the turbine exhaust.

Current techniques for obtaining low levels of exhaust pollutants in a gas turbine include:

- water injection into the combustor at additional customer operation cost—see, for example, U.S. Pat. Nos. 4,337,618; 4,290,558; 4,259,837; and 4,160,362;
- exhaust stack cleaning at additional installation and operation cost; and
- dry low NOx technology (fuel staging in the combustor) in a narrow, stable operating range—see, for example commonly assigned U.S. Pat. Nos. 4,292,801 and 4,982,570.

Existing combustion control systems which attempt to solve the problem of NOx emission by the use of variable geometry, whereby the fuel is burned with excess air, frequently operate with a relatively large variation in the pressure drop across the combustor. This variation occurs as the load on the turbine changes and it has an adverse effect on the overall operation. Further, because the control mechanism employed is usually integral with the combustor, the overall structure is mechanically complex and thus costly to build and maintain. As will be appreciated, combustors operate in a harsh external environment, up to 1000° F. and 250 p.s.i.a. pressure. Moreover, the combustion system is surrounded by a pressure vessel which is expensive and difficult to remove for maintenance purposes. The reliability of sensors and mechanical devices in this environment has also proven problematic. Another disadvantage resides in the fact that existing combustors cannot be easily retro-fitted to incorporate this type of control system.

The levels of allowable exhaust pollutants for power generation equipment will be continually reduced on a worldwide basis. However, as noted above, lean, premixed combustion technology results in combustors which are stable only in a very narrow operating range. Operating in this narrow range is difficult because the gas turbines used for power generation are required to deliver power over a wide range and not a single set point.

The operating range of the premixed combustors can be extended through the use of air staging. Air staging in a general sense may be defined as altering the distribution of air entering the combustor in a controlled manner during operation. In commonly assigned U.S. Pat. No. 4,255,927, a combustion system for gas turbines is disclosed in which air flow from the compressor is directed to both the reaction zone and to the downstream dilution zone in a manner which permits variable inverse proportioning of the air supplied to these zones. There are significant hardware requirements in this system, however, for distributing the flow of air between the zones.

In commonly assigned U.S. Pat. No. 4,944,149, an air staging apparatus is disclosed wherein a ring provided with a plurality of holes is adjustable axially relative to the combustion liner to selectively cover and uncover dilution air holes in the liner to thereby adjust the amount of air flowing into the dilution zone. Since the movable hardware is located within the liner, maintenance is problematic.

It is the principal object of this invention to provide a simplified but nevertheless novel apparatus for providing air staging which will not decrease plant reliability or increase maintenance costs.

More specifically, the object of this invention is to overcome the drawbacks of the prior art without hindering maintenance and reliability caused by mechanisms within the pressure vessel to control air staging. By adding external air staging to existing dry low NOx combustors, it is possible to increase the stable operating range of the combustor. This increase in range is desirable because gas turbines used for power generation must operate over a wide range of conditions, and not merely at a single set point.

In current design gas turbine approximately 90% of the total compressor discharge air must flow 10% through the combustor at all times (the remaining of air is leakage or used for cooling the hot gas path). The external air staging apparatus of this invention will allow the distribution of air into the combustor such that a large percentage of the air (approximately 20%) can bypass the combustion reaction zone by entering the combustor via dilution holes in the dilution zone.

Thus, in accordance with one exemplary embodiment of the invention, air staging is provided which requires no internal mechanical devices or sensors. The system is designed to locate these components externally of the pressure vessel where high reliability is demonstrated and maintenance easily achieved. In accordance with the invention, compressor discharge air for air staging is removed from the pressure vessel at (preferably) between 4 and 6 locations about the vessel. The air flows via a corresponding number of pipes to air dilution control valves which control amounts of compressor discharge air subsequently introduced to a common manifold which distributes air to each combustor in the pressure vessel. To this end, each combustor is provided with an annular manifold for feeding air into the combustion chamber through a plurality of dilution air feed tubes.

In its broader aspects, therefore, the present invention provides, in a gas turbine combustion system which includes a plurality of combustors within a pressure vessel, each combustor including a combustion liner defining a combustion chamber having a reaction zone and a dilution zone, the liner in the dilution zone provided with a plurality of circumferentially spaced dilution air feed holes; a flow shield surrounding each combustion liner in radially spaced relation thereto for feeding compressor discharge air to the combustion chamber, an improvement comprising air staging apparatus for controlling the amount of compressor discharge air introduced into each combustion chamber dilution zone via the dilution air feed holes comprising a plurality of pressure vessel extraction ports downstream of the combustion liner for introducing compressor discharge air into a first manifold externally surrounding the pressure vessel; and a single manifold feed pipe extending between the first manifold and each the combustion liner.

Since, essentially, all of the hardware associated with the air staging control system is located externally of the pressure vessel, maintenance and/or replacement of parts is facilitated with an overall reduction in cost.

Other objects and advantages of the present invention will become apparent from the detailed description which follows.

BRIEF DESCRIPTION OF THE DRAWINGS

FIG. 1 is a cross sectional view of a gas turbine combustor provided with external air staging in accordance with an exemplary embodiment of this invention; and FIG. 2 is an enlarged detail taken from FIG. 1.

DETAILED DESCRIPTION OF THE DRAWINGS

With reference to FIGS. 1 and 2, one combustor of a combustion system in accordance with this invention is shown generally at 10. The combustion system includes a combustion liner 12, generally cylindrical in shape, and which defines a combustion chamber 14. An end wall 16 terminates one end of the chamber 14 and is provided with a fuel nozzle (not shown) for introducing fuel into the combustion chamber in a conventional manner. The opposite end of the combustion chamber 14 opens to a transition piece 18 which couples the exit 20 of the combustion chamber to the input of a turbine, represented here by a single turbine blade 22.

An outer casing or flow shield 24 surrounds the combustion liner 12 in radially spaced relation thereto, permitting air from the compressor to reverse flow around the combustion liner 12 and into the combustion chamber 14 by means of an air swirler which is part of the fuel nozzle, again in a conventional manner. An outer casing 26 of a pressure vessel 27 surrounds the combustion chamber 14 and, in the area adjacent the transition piece 18, defines a chamber 28 where the compressor discharge air reverses direction to flow back toward the fuel nozzle where it ultimately provides air for the combustion process via introduction into the combustion liner 12.

In practice, it will be appreciated that more than one combustor will be associated with a single turbine. For example, each turbine may operate with between 6 and 18 combustors within a pressure vessel.

As is known in the art, the combustion chamber 14 includes a reaction zone 14R and a downstream dilution zone 14D. In accordance with an exemplary embodiment of this invention, compressor discharge air for air staging is removed from chamber 28 at a plurality of vessel extraction ports 30 (one shown). It will be understood that there may be as many as 4–6 extraction ports located about the pressure vessel 27 which surrounds all of the combustors.

Discharge air flowing into each of the extraction ports 30 passes through an associated conduit 32 to a dilution air control valve 34 and from there, via conduit 36 to a manifold 38 which is common to all of the combustors.

Manifold 38, which surrounds all of the combustors in the turbine, distributes air to each combustor via a respective manifold connector pipe 40. Each connector pipe 40, in turn, supplies air to an annular dilution air manifold 42 which surrounds the flow shield 24 of each combustor. The dilution manifold 42 supplies air to the dilution zone 14D of the combustion chamber 14 by means of a plurality of dilution air feed tubes 46 extending from a corresponding number of apertures 48 in the manifold 42, across the radial space between the flow shield 24 and liner 12, to a corresponding dilution air hole 44. Air feed tubes 46 are preferably secured by means of a conventional slip joint as best seen in FIG. 2. Other suitable connections may also be employed.

In operation, compressor discharge air extracted from chamber 28 via ports 30 for introduction into the dilution zone 14D, may be carefully controlled by means of the dilution air control valve 34 which controls the amount of air permitted to flow into the common manifold 38. This predetermined amount of dilution air is then uniformly delivered to each of the plurality of combustion chambers 12 by means of connector pipes 40, manifolds 42 and feed tubes 46. In this way, combustor emissions performance is optimized and the levels of pollutants in the machine exhaust reduced.

In accordance with one exemplary embodiment, as much as about 20% of compressor discharge air can bypass the reaction zone of the combustion chamber by entering via the air dilution holes.

Thus, the invention as described allows control of the percentage of air used for dilution, while necessarily also controlling the percentage of air entering the combustion reaction zone utilizing a minimum of hardware, with all serviceable parts located externally of the pressure vessel for ease of maintenance.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a gas turbine combustion system which includes a plurality of combustors within a pressure vessel, each combustor including a combustion liner defining a combustion chamber having a reaction zone and a dilution zone, the liner in the dilution zone provided with a plurality of circumferentially spaced dilution air feed holes; a flow shield surrounding each combustion liner in radially spaced relation thereto for reverse flowing compressor discharge air around said liner and into the combustion chamber reaction zone, the improvement comprising:

air staging apparatus for uniformly introducing a controlled amount of compressor discharge air into each combustion chamber dilution zone via said dilution air feed holes, said air staging apparatus comprising a plurality of pressure vessel extraction ports in said pressure vessel, downstream of said combustion liners relative to flow through the combustion liners; a first manifold surrounding said pressure vessel and connected to each of said extraction ports; a dilution air control valve located between each extraction port and said first manifold; and a plurality of manifold connector pipes, each extending from said first manifold into said pressure vessel and into communication with the dilution zone of a respective one of said combustion chambers.

2. The gas turbine combustion system of claim 1 and further including a plurality of second manifolds, each surrounding the flow shield of a respective combustor for supplying air from said manifold connector pipe uniformly to said dilution zone via said plurality of dilution air feed holes.

3. The gas turbine combustion system of claim 1 wherein said pressure vessel is provided with between 4 and 6 extraction ports.

4. The gas turbine combustion system of claim 1 wherein said valve is effective to divert about 20% of compressor discharge air available for combustion to the combustor dilution zone.

5. In a gas turbine combustion system which includes a plurality of combustors within a pressure vessel, each combustor including a combustion liner defining a combustion chamber having a reaction zone and a dilution zone, the liner in the dilution zone provided with a plurality of circumferentially spaced dilution air feed holes; a flow shield surrounding each combustion liner in radially spaced relation thereto for feeding compressor discharge air to the combustion chamber reaction zone, the improvement comprising:

air staging apparatus for uniformly introducing a controlled amount of compressor discharge air into each combustion chamber dilution zone via said dilution air feed holes, said apparatus including a plurality of pressure vessel extraction ports and associated conduits for introducing compressor discharge air into a first manifold located externally of the pressure vessel and common to said plurality of combustors; a dilution air control valve located between each extraction port and said first manifold; a plurality of second, annular manifolds in communication with said first manifold and located within said pressure vessel, each of said plurality of second manifolds surrounding the flow shield of a respective combustor, each of said second manifolds including connector tubes communicating with each of said dilution air feed holes in said combustion liner.

6. The gas turbine combustion system of claim 5 wherein said plurality of pressure vessel extraction ports are located downstream of said combustion liner relative to flow through the combustion liner, in a transition area between said liner and an associated turbine.

7. A gas turbine combustion system comprising a plurality of combustors within a pressure vessel, each combustor including a combustion liner defining a combustion chamber having a reaction zone and a dilution zone, the liner in the dilution zone provided with a plurality of circumferentially spaced dilution air feed holes; a flow shield surrounding each combustion liner in radially spaced relation thereto for feeding compressor discharge air to the combustion chamber reaction zone;

air staging apparatus for uniformly introducing a controlled amount of compressor discharge air into each combustion chamber dilution zone via said dilution air feed holes comprising a plurality of pressure vessel extraction ports downstream of said combustion liner relative to flow through the combustion liner, for introducing compressor discharge air into a first manifold externally surrounding the pressure vessel;

a plurality of second manifolds within the pressure vessel, each surrounding the flow shield of a respective combustor and communicating with the plurality of dilution air feed holes of an associated combustion liner;

a plurality of manifold connector pipes extending between said first manifold and each of said plurality of second manifolds;

and further including a dilution air control valve located between each extraction port and said first manifold.

8. The gas turbine combustion system of claim 7 wherein said valve is effective to divert about 20% of compressor discharge air available for combustion to the combustor dilution zone.

* * * * *